US007044358B2

(12) United States Patent
Gratz

(10) Patent No.: US 7,044,358 B2
(45) Date of Patent: May 16, 2006

(54) TWO-SIDED ROLL SUPPORT WITH MULTIPLE RIBS

(76) Inventor: Jeffrey J. Gratz, W29049 Richter Ave., Hartland, WI (US) 53029

( * ) Notice: Subject to any disclaimer, the term of this patent is extended or adjusted under 35 U.S.C. 154(b) by 398 days.

(21) Appl. No.: 09/836,769

(22) Filed: Apr. 17, 2001

(65) Prior Publication Data

US 2003/0159959 A1 Aug. 28, 2003

(51) Int. Cl.
*B65D 5/00* (2006.01)

(52) U.S. Cl. ..... 229/100; 206/394; 206/585; 206/593

(58) Field of Classification Search ..... 229/100; 206/391, 394, 443, 593, 389, 523, 585, 587
See application file for complete search history.

(56) References Cited

U.S. PATENT DOCUMENTS

| | | | | |
|---|---|---|---|---|
| 2,783,879 | A * | 3/1957 | Emery | 206/593 X |
| 2,808,189 | A * | 10/1957 | Williams | 206/593 X |
| 2,815,856 | A * | 10/1957 | Caswell | 206/426 |
| 3,135,445 | A * | 6/1964 | Reifers | 206/160 |
| 3,708,084 | A | 1/1973 | Bixler et al. | |
| 4,195,732 | A | 4/1980 | Bell | |
| 4,435,463 | A | 3/1984 | Roellchen | |
| 4,705,170 | A | 11/1987 | Creaden | |
| 4,832,196 | A | 5/1989 | Butler | |
| 4,936,453 | A * | 6/1990 | Knitter | 206/593 X |
| 4,942,965 | A * | 7/1990 | Comer | 206/419 |
| 5,058,744 | A * | 10/1991 | Creaden | 206/419 |
| D328,034 | S | 7/1992 | Creaden | |
| D332,571 | S | 1/1993 | Creaden | |
| 5,318,223 | A | 6/1994 | Gale | |
| 5,533,667 | A | 7/1996 | Gale | |
| D381,180 | S | 7/1997 | Schueneman et al. | |
| D385,080 | S | 10/1997 | Schueneman et al. | |
| 5,678,692 | A | 10/1997 | Gratz | |
| 5,797,485 | A | 8/1998 | Gale | |
| 5,806,683 | A | 9/1998 | Gale | |
| D400,441 | S | 11/1998 | Warren | |
| D403,961 | S | 1/1999 | Warren | |
| D408,737 | S | 4/1999 | Warren | |
| 5,899,331 | A | 5/1999 | Warren, Jr. | |
| 5,934,467 | A | 8/1999 | Gilfert et al. | |
| 5,950,829 | A | 9/1999 | Gale | |
| 5,975,300 | A | 11/1999 | Gale | |
| 6,039,184 | A | 3/2000 | Gale | |
| 6,142,440 | A | 11/2000 | Gratz et al. | |

* cited by examiner

*Primary Examiner*—Tri M. Mai
(74) *Attorney, Agent, or Firm*—Boyle Fredrickson Newholm Stein & Gratz S.C.

(57) ABSTRACT

A structure for supporting a plurality of objects having cylindrical characteristics. The structure includes a first side and a second side, the first side having at least two rib structures spaced apart from one another by valleys. The rib structures are formed as an alternating series of arches and depressions. The depressions define the retaining position for the objects. The arches include lands with cavities that enhance the structural characteristics of the ribs. The second side includes three or more spaced rib sections that are formed as an alternating series of peaks and depressions. The depressions of the second side correspond to the depressions of the first side. The rib sections of the second side correspond to the valleys of the first side. The arches of the first side are relatively higher than the equivalents in the prior art in order to provide greater surface area contact with the cylindrical objects to be retained.

6 Claims, 2 Drawing Sheets

TWO-SIDED ROLL SUPPORT WITH MULTIPLE RIBS

BACKGROUND OF THE INVENTION

1. Field of the Invention

The present invention relates to structures for the packaging of cylindrical structures. More particularly, the present invention relates to fabricated supports for stabilizing the position of cylindrical structures, such as rolls of material, and other structures having at least some cylindrical features, during transport.

2. Description of the Prior Art

Web materials such as plastic film are used for a variety of purposes including the sealing of other materials. Web materials are typically fabricated in roll form and used in their particular applications in the same form. However, such cylindrical products are often difficult to transport because they can become displaced relatively easily when subject to the conditions of roadway travel. In addition, it is undesirable to stack heavy cylindrical objects directly on one another because their weight can cause deformation. For that reason, cylindrical objects such as web rolls are ordinarily retained by supports that space adjacent ones apart and prevent rolling movement. Such supports must be fabricated so that product damage is minimized. Failure to minimize damage during transport can cause defects that prevent use of the product for its intended purpose. Further, since it is most efficient to stack multiple layers of product for a single transport effort, the support must be strong enough to enable multi-layered stacking that does not cause product deformation.

Some supports for cylindrical products have been fabricated of polystyrene. The polystyrene supports generally provide sufficient strength to adequately protect a plurality of web rolls, for example, stacked together for transport. However, it is well known that polystyrene and other polymeric-based products are generally perceived as environmentally undesirable in that they are stable and unlikely to degrade over a long period. For that reason, there has been increasing interest in fabricating such web supports, and other sorts of packaging for that matter, that are fabricated of more nature-friendly materials, including recyclable materials, including pulp-based supports. Examples of molded pulp supports are described in U.S. Pat. Nos. 5,899,331 and 5,934,467. Those references describe molded roll supports having recesses and depressions that provide structural strength to the rolls and that also provide retention sites for cradling the rolls to be transported.

For the most part, the present molded supports have only one side (the smooth side) configured to support products having cylindrical characteristics, while the other side (the rough side) is designed to provide suitable structural support. In order to enable multi-layer stacking, the molded supports are formed of pairs of support structures hingedly connected together so that the smooth sides face outwardly while the rough sides are placed back-to-back. In that way, the rolls to be supported come in contact only with the smooth sides of the double, hinged, support.

Unfortunately, the supports that presently exist are not completely effective in preventing roll damage during transport. Specifically, the support materials have some compressibility so that when a plurality of relatively heavy objects are placed on them, there is some thickness reduction. In addition, it is ordinary practice for transporters to place banding straps around the perimeter of a stack of objects. The banding is tightened to prevent individual objects in the stack from slipping. However, that tightening causes additional compression of the support material, particularly the hinged support structures. During transport, that additional compression that occurs after banding can result in less than complete retention of individual objects. As a result, the banding is loosened and the objects are prone to spinning and other forms of displacement that can cause in damage.

Therefore, what is needed is a cylindrical object support that provides suitable retention capability to minimize object movement throughout the transport process. What is also needed is such an object support that can be fabricated of conventional materials including, but not limited to, pulp-based materials. Further, what is needed is such an object support that can be used to retain multiple stacks of objects with a reduction in the types of compressive characteristics experienced by hinged supports.

SUMMARY OF THE INVENTION

It is an object of the present invention to provide a cylindrical object support that provides suitable retention capability to minimize object movement throughout the transport process. It is also an object of the present invention to provide such an object support that can be fabricated of conventional materials including, but not limited to, pulp-based materials. Further, it is another object of the present invention to provide such an object support that can be used to retain multiple stacks of objects with a reduction in the types of compressive characteristics experienced by hinged supports.

These and other objects of the present invention are achieved through the unique design of a cylindrical object support formed in a single layer and providing greater surface contact area between the support and the objects to be supported. The support of the present invention has a first support surface and a second support surface. The support is an elongated member having a pair of rib regions running parallel to one another on the first support surface. The ribs each include alternating arches and depressions, terminating at the ends of the elongate member with terminating arches that act to prevent end rolls from falling off. The terminating arches remain part of opposing end walls that define the end perimeter of the elongated member. The ribs are spaced from one another by an inner valley and each of the ribs of the first side is adjacent to an outer valley that are adjacent to side walls of the first side.

On the second side of the elongated member, the valleys of the first side are three ribs in parallel that are also configured as respective series of alternating arches and depressions. The depressions of the ribs of the first side define the positioning of the underside of a web product to be retained by the support on that side. For that reason, the depressions of the parallel ribs are aligned. Similarly, the depressions of the second side are designed to retain the topside of a web product and so are also aligned. In particular, the arches of the first side substantially define the configuration of the depressions of the second side and the depressions of the first side substantially define the configuration of the arches of the second side. The combination of multiple ribs on the first side and multiple ribs on the second side result in a single-piece web support that retains adjacent sets of objects on each of its sides. The arches of the ribs are preferably of height greater than existing support structures to ensure no slip-out of objects during transit. That is, they provide more surface area contact with the object along a greater extent of the circumference of the object. In addition, the support of the present invention is relatively wider than corresponding supports for equivalent objects. The combination of the relatively taller rib arches and wider structure adds to the overall critical surface area contact between the support and the objects being supported. For the purpose of this disclosure, the critical surface area is that area of contact associated with the interface between the support and where adjacent objects are stacked atop one another.

In order to further minimize the possibility of loosening of a banded stack of objects, the present invention includes lands at the tops of the arches of the ribs of the first side. The lands are preferably configured with cavities that reinforce the structural strength of the land that defines the upper dimensions of the arches. Specifically, while a flat land provides some structural strength to the ribs, adding a cavity to a land increases the transverse strength by effectively adding more surface area to the lands within the same space. The cavities essentially create two lands rather than a single land component. Adjacent objects positioned on the first side of the support meet substantially greater resistance to inward movement due to the cavity-inclusive configuration of the lands. That ensures that the adjacent objects are much less likely to move inwardly toward the middle of the stack due to excessive compression of the support in that localized region.

The present invention provides an improved object support that enables the stacking and retention of cylindrical and semi-cylindrical objects without resorting to hinged or otherwise double-configured structures. These and other advantages of the present invention will become apparent upon review of the following detailed description, the accompanying drawings, and the claims.

DETAILED DESCRIPTION OF THE PREFERRED EMBODIMENT OF THE INVENTION

Figure 1:
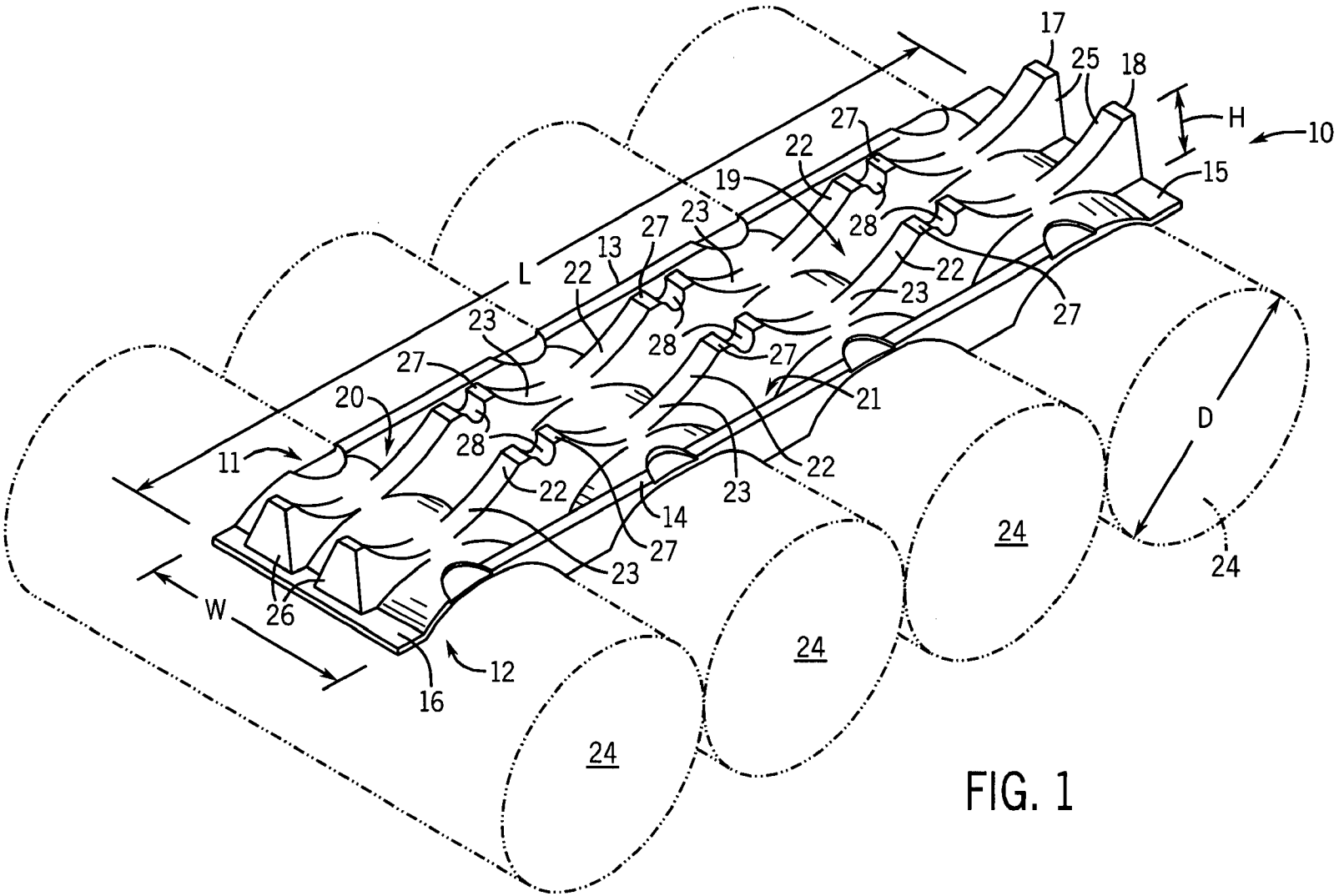
FIG. 1 is a simplified perspective view of the first side of the support of the present invention shown on a plurality of rolls supported by the second side thereof.
Figure 2:
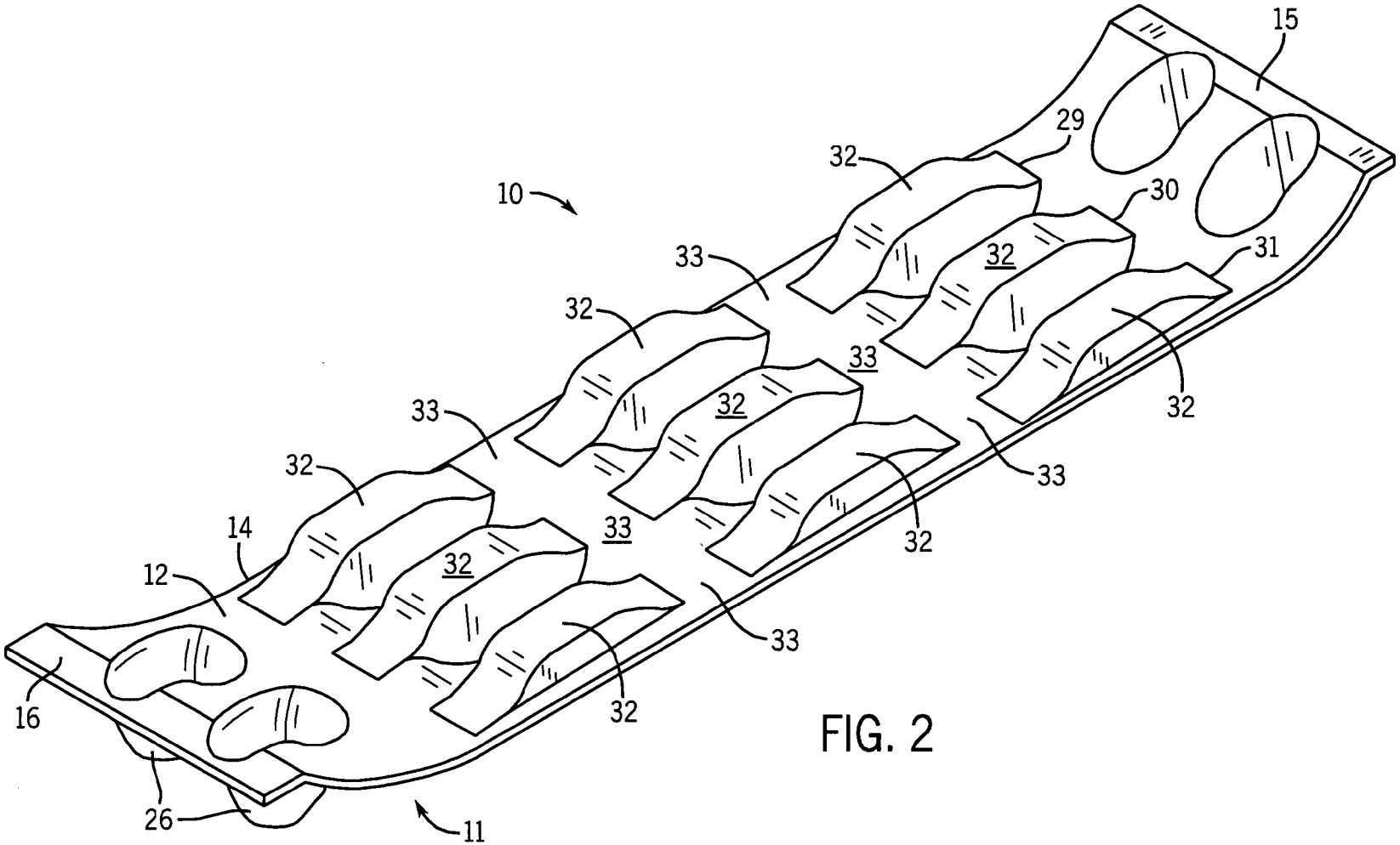
FIG. 2 is a simplified perspective view of the second side of the support of the present invention shown without the plurality of rolls thereon.

An object support structure 10 of the present invention is shown in FIGS. 1 and 2. The structure includes a first side 11 and an opposing second side 12. Either or both of the two sides may be molded with a smooth design or a rough design. The structure 10 is preferably fabricated of moldable pulp fiber material but may also be fabricated on non-metallic polymeric material, such as plastic sheet, for example. The structure 10 is of selectable length L and width W sufficient to ensure that two spaced rib sections may be established on said first side 11. The first side 11 includes opposing first sidewalls 13 and 14 and two opposing endwalls 15 and 16. The sidewalls and endwalls define the perimeter of the elongate structure that is the roll support structure 10.

The structure 10 includes on the first side 11 a first rib section 17 and a second rib section 18 that is substantially parallel to the first rib section 17. The first rib section 17 and the second rib section 18 are spaced apart from one another by an inner valley 19 and they are spaced from the sidewalls 13 and 14 by outer valleys 20 and 21, respectively. All of the valleys are preferably of substantially the same configuration. Each of the rib sections 17 and 18 includes an alternating series of two or more interior arches 22 and semi-cylindrical depressions 23. The arches 22 and the depressions 23 are preferably sized and configured to retain securely within the depressions 23 rolls 24 so that the contact area of the depressions 23 to the rolls 24 is substantial. Although rolls of web material are shown being retained by the support 10, it is to be understood that the support 10 may be employed to retain other objects having cylindrical design.

Continuing with the example, for a roll having a diameter D, the completed circle defined by the circumference of the depressions 23 preferably has a diameter greater than D and the arches 22 are of a height sufficient to produce adequate contact with the rolls 24. For example, for a roll having a diameter equal to about 10", the arches 22 should be at a height of at least about 1.75". It is to be noted that at least the depressions 23 of the respective rib sections 17 and 18 are to be substantially aligned with one another so that the rolls 24 may reside therein.

With continuing reference to FIG. 1, the first side 11 of the structure 10 further includes a first set of end arches 25 and a second set of end arches 26 that are adjacent to and form a part of endwalls 15 and 16, respectively. They are preferably about the same height as the arches 22, but in some instances may be taller if desired. Additionally, the inner arches 22 preferably each includes a land 27 that defines the height of the respective inner arches. Each land 27 provides structural reinforcement to the rib sections 17 and 18 and has a substantially centered cavity 28 spaced between two top sections of the individual lands 27. These cavities 28 enhance the structural characteristics of the individual arches 22, preventing excessive compression of that portion of the structure 10, particularly in the center of the structure 10 during full loading.

As illustrated in FIG. 2, the second side 12 of the structure 10 is a modified inverted version of the first side 11. In particular, the second side 12 includes a set of parallel rib sections 29–31 that correspond to the valleys 19–21 of the first side 11. The rib sections 29–31 include a series of alternating peaks 32 and depressions 33. Although the peaks 32 may have lands, they do not in the preferred embodiment of the present invention, as that would affect the design of the first side 11 to an extent. The second side 12 is designed to retain within the aligned depressions 33 what would effectively be the topside of the rolls 24, essentially as shown in FIG. 1. On the other hand, the first side 11 is designed to retain thereon the underside of the rolls 24. The peaks 32 are sufficiently sized in height to aid in retaining the rolls within the depressions 33. It is to be noted that the rib sections 29–31 are spaced apart from one another by second side valleys that correspond to the underside configuration of the arches 22 and their lands 27 of the first side 11. The structure 10 of the present invention is relatively wider than corresponding supports of the prior art to ensure that multiple ribs may be fabricated into the second side 12. That wider design in combination with relatively taller ribs produces substantially greater critical surface area contact of the structure 10 with whatever objects are being supported thereon.

The roll support structure 10 of the present invention provides an improved support that enables the stacking and retention of cylindrical objects without resorting to double-configured structures. The structure 10 is formed of a single layer and improved structural features to minimize compression and increase surface area contact. While the invention has been described with reference to a particular example embodiment, it is intended to cover all modifications and equivalents as described in the following claims.

What is claimed is:

1. A support structure for supporting an object, comprising:

an elongated member extending along a longitudinal axis and having first and second sides, first and second edges and a thickness;

a first set of ribs projecting from the first side of the elongated member and corresponding to a first set of depressions in the second side of the elongated member, the first set of ribs including first, second and third ribs axially spaced from each other along an axis transverse to the longitudinal axis;

a second set of ribs projecting from the first side of the elongated member at a location axially spaced from the first set of ribs so as to define an object receiving cradle therebetween, the second set of ribs including first, second and third ribs axially spaced from each other along a second axis transverse to the longitudinal axis of the elongated member;

a first rib projecting from the second side of the elongated member and corresponding to a first depression in the first side of the elongated member between the first and second ribs of the first set of ribs; and a second rib projecting from the second side of the elongated member at a location axially spaced the first rib projecting from the second side of the elongated member so as to define a second side object receiving cradle therebetween, the second rib projecting from the second side of the elongated member corresponding to a second depression in the first side of the elongated member between the first and second ribs of the second set of ribs;

wherein:

the object receiving cradle on the first side of the elongated member includes a midpoint generally equidistant between the first and second set of ribs;

the object receiving cradle on the second side of the elongated member includes a midpoint generally equidistant between the first and second ribs;

the midpoint of the object receiving cradle on the first side of the elongated member and the midpoint of the second side object receiving cradle are axially aligned and are separated by a distance generally equal to the thickness of the elongated member.

2. The support structure of claim 1 wherein the second ribs of the each of the sets of ribs are axially spaced from edges of the elongated member.

3. The support structure of claim 1 wherein the first, second and third ribs of the first set of ribs and the first, second and third ribs of the second set of ribs have a predetermined height and wherein the first and second ribs projecting from the second side of the elongated member have a predetermined height.

4. The support structure of claim 3 wherein the predetermined height of the first, second and third ribs of the first set of ribs and of the first, second and third ribs of the second set of ribs is generally equal to the predetermined height of the first and second ribs projecting from the second side of the elongated member.

5. The support structure of claim 1 further comprising a third set of ribs projecting from the first side of the elongated member at a location axially spaced from the second set of ribs so as to define a second object receiving cradle therebetween, the third set of ribs including first, second and third ribs axially spaced from each other along a third axis transverse to the longitudinal axis of the elongated member.

6. A support structure for supporting an object, comprising:

an elongated member extending along a longitudinal axis and having first and second sides, first and second edges, first and second ends, and a thickness, the first side of the elongated member including:

a first plurality of ribs projecting therefrom and being spaced between the first and second ends along a first axis;

a second plurality of ribs projecting therefrom and being spaced between the first and second ends along a second axis;

a third plurality of ribs projecting therefrom and being spaced between the first and second ends along a third axis;

a first plurality of depressions formed therein and being spaced between the first and second ends along a first depression axis disposed between the first and second axis; and a second plurality of depressions formed therein and being spaced between the first and second ends along a second depression axis disposed between the second and third axis;

wherein:

the first plurality of ribs projecting from the first side of the elongated member includes a first rib and a second rib, the first rib and the second rib partially defining a first object receiving cradle therebetween;

each of the first plurality of ribs is aligned with a corresponding rib of the second plurality of ribs and with a corresponding rib of the third plurality of ribs along a corresponding axis transverse to the longitudinal axis of the elongated member;

each of the first plurality of depressions is disposed between one of the first plurality of ribs and one of the second plurality of ribs and wherein each of the second plurality of depressions is disposed between one of the second plurality of ribs and one of the third plurality of ribs;

the first plurality of depressions form corresponding ribs projecting from the second side of the elongated member, the ribs projecting from the second side of the elongated member being spaced between the first and second ends along the first depression axis;

the ribs projecting from the second side of the elongated member includes a first rib and a second rib, the first rib and the second rib defining a second side object receiving cradle therebetween;

the first object receiving cradle on the first side of the elongated member includes a midpoint generally equidistant between the first and second ribs of the first plurality of ribs projecting from the first side of the elongated member;

the second object receiving cradle on the second side of the elongated member includes a midpoint generally equidistant between the first and second ribs projecting from the second side of the elongated member; and wherein the midpoint of the first object receiving cradle and the midpoint of the second object receiving cradle are axially aligned and are separated by the thickness of the elongated member.

* * * * *